United States Patent [19]

Fowler et al.

[11] 4,323,316

[45] Apr. 6, 1982

[54] SHORTHAND MACHINE PAPER GAUGE

[75] Inventors: Paul J. Fowler, Glenview; Ralph E. Zum Bahlen, Chicago, both of Ill.

[73] Assignee: Stenograph Corporation, Skokie, Ill.

[21] Appl. No.: 123,122

[22] Filed: Feb. 21, 1980

[51] Int. Cl.[3] ..... B41J 3/26

[52] U.S. Cl. ..... 400/91; 400/703; 400/708; 116/285; 177/225

[58] Field of Search ..... 400/703, 708, 707, 91, 400/707.2, 707.1; 116/285, 291, 312; 177/225, 234

[56] References Cited

U.S. PATENT DOCUMENTS

| | | | |
|---|---|---|---|
| 1,578,137 | 3/1926 | Kaplan | 177/225 |
| 1,807,313 | 5/1931 | Hines | 177/225 |
| 2,804,960 | 9/1957 | Yutang | 400/707.2 |
| 2,821,953 | 2/1958 | Langbart | 116/312 |
| 2,845,162 | 7/1958 | Picard | 400/707.1 |
| 2,877,741 | 3/1959 | Wilson | 400/91 |
| 3,084,755 | 4/1963 | Kaiser | 177/234 |
| 3,532,206 | 10/1970 | Bennett | 400/707.1 |
| 3,638,776 | 2/1972 | Ridge | 400/91 |

OTHER PUBLICATIONS

Borm, "Low Paper Sense," IBM Technical Disclosure Bulletin vol. 22, No. 8A, pp. 3283–3284, 1/80.

DeBoo, "Low Paper Supply Alarm", Western Electric Technical Digest, No. 97, pp. 3–4.

*Primary Examiner*—William Pieprz

*Attorney, Agent, or Firm*—Lee, Smith & Jager

[57] ABSTRACT

A paper gauge for use with a shorthand machine to determine the quantity of paper remaining in the shorthand machine. A scale arm weighs the paper tape in the machine and the gauge is calibrated by weight to give the shorthand machine operator a reading in terms of the number of folds left in the paper strip. The displacement of the scale arm is proportional to the weight of the paper tape and movement of the paper gauge indicating means is proportional to displacement of the scale arm. Accurate readings are facilitated by the use of a hinged tray plate to hold the paper tape in correct position on the scale arm. An "L"-shaped end portion of the tray plate in hinged engagement with the base portion of the tray plate successfully prevents the used portion of the paper tape from urging against the remaining supply and thereby causing an inaccurate reading.

12 Claims, 9 Drawing Figures

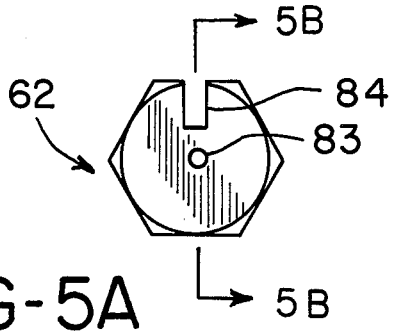
FIG-5A
FIG-8
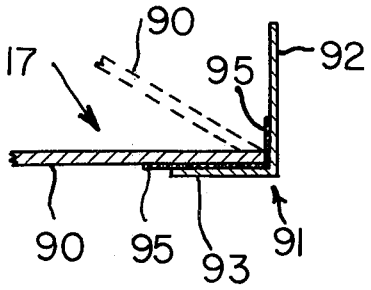
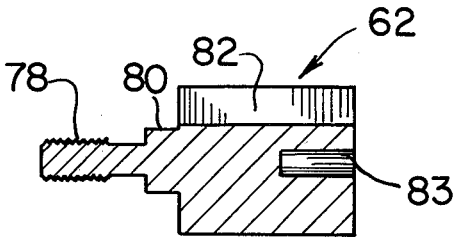
FIG-5B
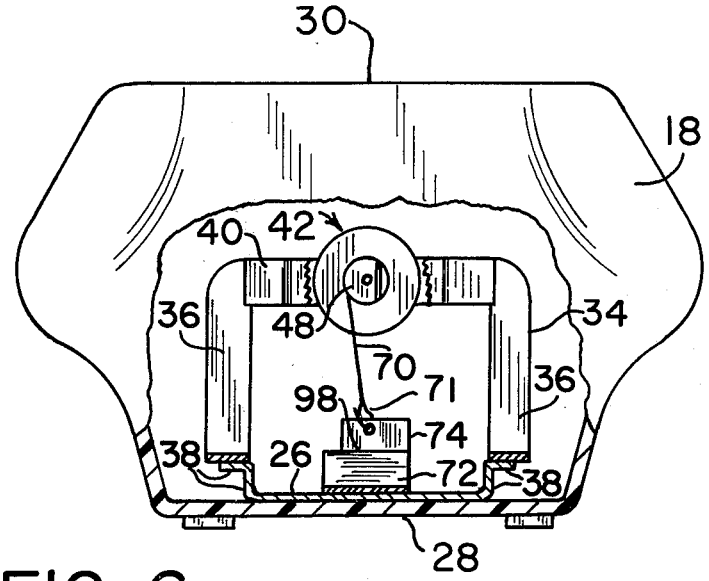
FIG-6

SHORTHAND MACHINE PAPER GAUGE

THE BACKGROUND

The present invention relates to shorthand machines and more particularly to a device for measuring and indicating the amount of paper remaining in a shorthand machine before reloading is necessary.

Machine shorthand operators must be constantly aware of the amount of paper tape supply remaining in the shorthand machine so that they will not be caught by surprise when the supply runs out. By knowing that the paper supply is running low, the operator may plan ahead and add additional paper during a pause in the commentary to be recorded.

Shorthand machines are often used to record trial and deposition testimony and to take office dictation of letters and memos and the like. If the operator is unaware of the paper supply, the operator may be required to temporarily interrupt the speaker's "train of thought", or even disrupt an entire proceeding while the operator loads additional paper into the shorthand machine, causing still greater inconvenience.

Such disruption becomes critical when the shorthand machine operator is recording a sworn deposition or court room testimony. While the last few folds of paper tape are usually marked, this does not give the shorthand machine operator very much advance notice of the end of the tape. If the paper supply runs out at an inopportune time, the entire deposition or trial must be temporarily halted to give the operator time to reload the machine. This in turn results in increased pressure on the operator, who already is under considerable pressure to perform flawlessly.

In addition to disruption of the proceedings and increased pressure on the operator, the necessity of paper loading at an inopportune time may result in the permanent loss of some testimony, as a witness may change his statement once he has had time to think and realizes his previous statement has not been recorded, causing additional confusion in the proceedings.

Trained shorthand machine operators realize they must be aware of the paper supply and consequently make it a habit to check the paper tray of the machine periodically. However, the constant knowledge that the paper tray must be continually checked is a distraction for the operator, who must be highly alert and attuned to the commentary being recorded. Although perhaps seemingly minor, such a distraction may be the crucial difference for successful reporting when two or three people are speaking quickly and almost simultaneously.

Further still, visually checking the actual paper supply in the paper tray only gives the operator a vague idea of how much paper remains. The paper tape is usually manufactured into folds such that it looks like a stack of paper, although it is one continuous strip. When the operator checks the paper tray all that is seen is the top fold of the paper and the operator must rely on depth perception to guess how much paper remains.

Operators guess how much paper remains by looking over the top of the machine at the paper tape output, which is fed into and stored in the paper tray located at the back of the machine. The operator must estimate the height of the paper tape output stack, the estimate being dependent on the accuracy of the previously mentioned depth perception, and from this make a further estimate of the amount of paper tape remaining, this latter estimate being dependent on the operator's perception of how much paper was originally loaded in the shorthand machine.

An alternate method to determine paper tape supply is to somehow look underneath the keyboard into the recesses of the machine, view the paper tape supply and estimate the amount of paper remaining. Both these methods are inaccurate and time consuming.

Until now, the above described methods have been the only ways by which shorthand machine operators could ascertain the amount of paper remaining in the machine and the only ways to plan ahead for reloading of the paper supply.

SUMMARY OF THE INVENTION

The present invention is directed to a shorthand machine paper gauge which determines the amount of paper tape remaining in the machine. In accordance with one embodiment of that invention the paper gauge includes a scale arm which supports the supply of paper tape within the machine and which moves between two positions. The scale arm is resiliently urged toward the first or raised position, which is assumed when there is no paper tape within the machine. The scale arm reaches the second or lowered position when a predetermined amount of paper tape is within the machine. As the paper tape is used the scale arm moves toward the first position. Indicating means is operatively connected to the scale arm to indicate the position of the scale arm, thereby providing a read-out as to how much of the paper tape remains in the machine.

The paper gauge may be integrated into the interior of the machine in such a way that it does not interfere with the internal workings of the machine. Nothing encumbers the exterior of the machine and the keyboard operates in a manner identical to that for a machine without the paper gauge.

In the preferred embodiment, the scale arm is flexible and is fastened at one end to the paper loading track of the machine. The free end of the scale arm is resiliently urged toward the first position by a biasing means embodied in a drum assembly. The movement of the indicating means is substantially proportional to the motion of the scale arm and thus, also to the number of folds of paper tape remaining to be used. The indicating means is preferably placed such that it is in the operator's "line of sight." The drum assembly cooperates with the scale arm not only to urge the scale arm toward its raised or first position, but it carries the indicating means for indicating the position of the scale arm.

To assure proper loading of paper into the machine and to give greater accuracy to the paper gauge it is preferred that there be a special paper loading means, which in the preferred embodiment includes a modified tray plate on which the paper tape supply rests. This loading means properly aligns and centers the paper tape as it is being loaded into the machine. With this loading means the paper tape will be prevented from leaning to one side, which might twist the scale arm and affect scale arm displacement, thus causing an inaccurate read-out on the indicating means. The loading means will further ensure that the paper tape is loaded all the way into the machine, resulting in proper displacement of the scale arm and ensuring accurate operation of the paper gauge. Further still, the loading means is constructed so as to prevent the used paper tape output, which is stored in the paper tray immediately behind the paper tape supply, from urging against either the supply paper or a portion of the tray plate which would displace the scale arm from its "true," accurate position. It is preferred that the paper gauge be adjustable so that the weight of the loading means itself becomes a tare weight.

The invention has numerous advantages, the foremost of these being accuracy and convenience. Instead of having to peer over or inside the machine and guess the amount of paper remaining, the operator need only glance at the paper gauge indicating means located near the keyboard. The reading given by the indicating means is sufficiently accurate to allow proper planning of paper reloading. The paper gauge provides a constant readout, requiring no physical action by the operator such as pressing a button, nor any other action which would require lifting the operator's hands from the "keyboard ready" position.

The readout allows the operator time to plan for paper tape replacement so that he or she may take advantage of any pause in the recorded commentary. Thus, the operator need not constantly worry about the paper tape supply and may give full attention to the operator's primary responsibility; accurate recordation of conversation, dictation and testimony. Appropriate timing of paper replacement will avoid the need to play "catchup" with the speech to be recorded or avoid missing some speech entirely.

BRIEF DESCRIPTION OF THE DRAWINGS

FIG. 5A is an end elevational view of the drum assembly bearing.

FIG. 5B is a cross-sectional view taken substantially along line 5B—5B of FIG. 5A.

FIG. 6 is an end elevational view of the shorthand machine taken partially in cross section substantially along line 6—6 of FIG. 2.

FIG. 8 is a detailed side elevational view of the tray plate illustrating the hinged movement of the base portion.

DETAILED DESCRIPTION OF THE PREFERRED EMBODIMENT

Figure 1:
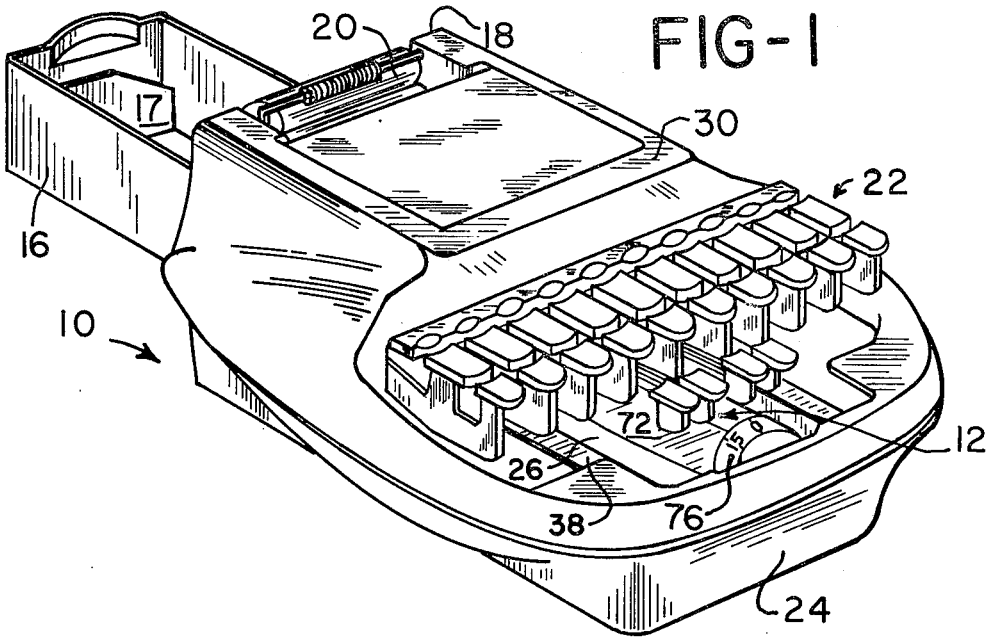
FIG. 1 is a perspective view of a shorthand machine having installed therein a paper gauge constructed in accordance with this invention.

A typical shorthand machine 10 is best seen in FIG. 1. As shown in FIGS. 1, 2, 3 and 7, the paper gauge 12 is integrated directly into the machine 10.

Figure 2:
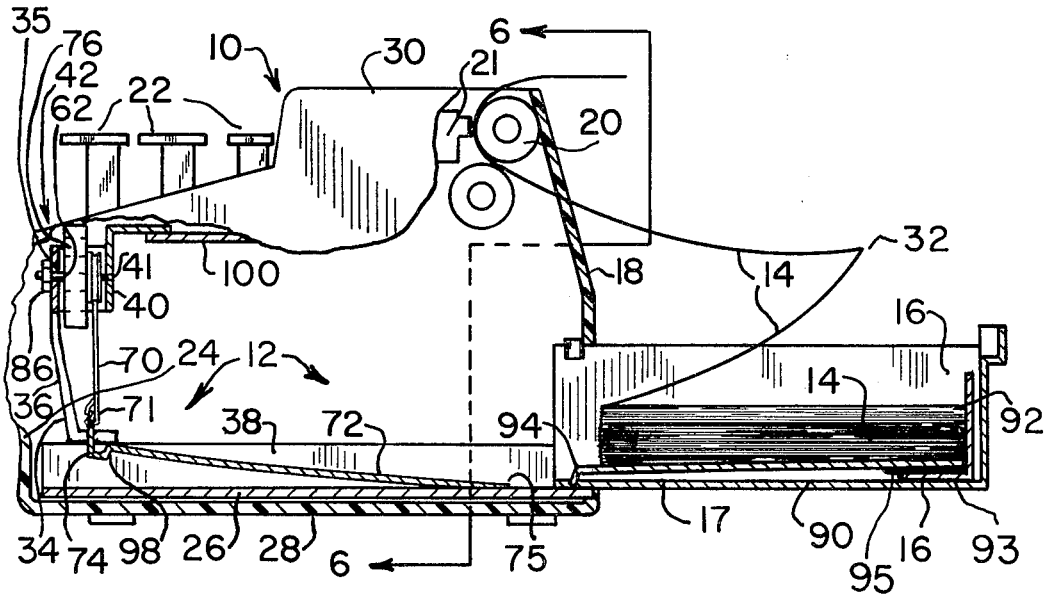
FIG. 2 is a side elevation view partially cross sectioned through the shorthand machine and paper gauge, showing the paper tape as it is being loaded into the machine.

In this shorthand machine, paper tape 14 is placed in the paper tray 16 which extends from the platen end 18 of the machine. The paper tape 14 is then threaded between the platen 20 and type bars 21, as shown in FIG. 2. The paper tape 14 is then loaded into the machine 10 by pushing the entire paper tape forward toward the keyboard 22 and keyboard end 24 of the machine. The paper tray 16 remains extended at the platen end 18 of the machine. The paper tape 14 is thus pushed onto the paper track 26 located at the bottom 28 of the shorthand machine, extending generally from the platen end 18 to the keyboard end 22. The paper track 26 provides a clear openspace for the paper tape 14 within the machine 10. As the shorthand machine is operated, the paper tape 14 is fed over the platen 20 and out the top 30 of the machine, such that it falls back into the paper tray 16. Because of the preformed creases 32 in the paper tape 14, the paper tape is neatly stacked into the paper tray 16.

To facilitate loading and unloading the paper tape 14 into and out of the typical shorthand machine 10, a tray plate is provided. A modified tray plate 17 used in the present invention, see FIGS. 1, 2, 3, 7 and 8, will be more fully hereinafter described. The tray plate initially rests in the paper tray 16. The paper tape 14 is placed on top of the tray plate and the tray plate with the paper tape thereon is easily loaded into the shorthand machine.

The above described method of operation of the shorthand machine is not changed by the present invention. As shown in FIG. 6, an inverted U-shaped outer support bracket 34 is secured to the shorthand machine such that the two legs 36 straddle the paper track 26 at the keyboard end 24 of the machine 10. On a typical shorthand machine, such as manufactured by Stenograph Corporation of Skokie, Ill., the paper track 26 includes raised, longitudinal steps 38 at the outer edges of the paper track. The legs 36 of the outer support bracket 34 may easily be mounted on these longitudinal steps 38.

An inner support bracket 40 is secured to the side of the outer support bracket 34 facing the platen end 18. The outer and inner support brackets 34, 40 have openings 35 and 41, respectively (see FIG. 2). The openings are the same height above the paper track 26 and are centered above the longitudinal axis of the paper track 26.

Figure 4:
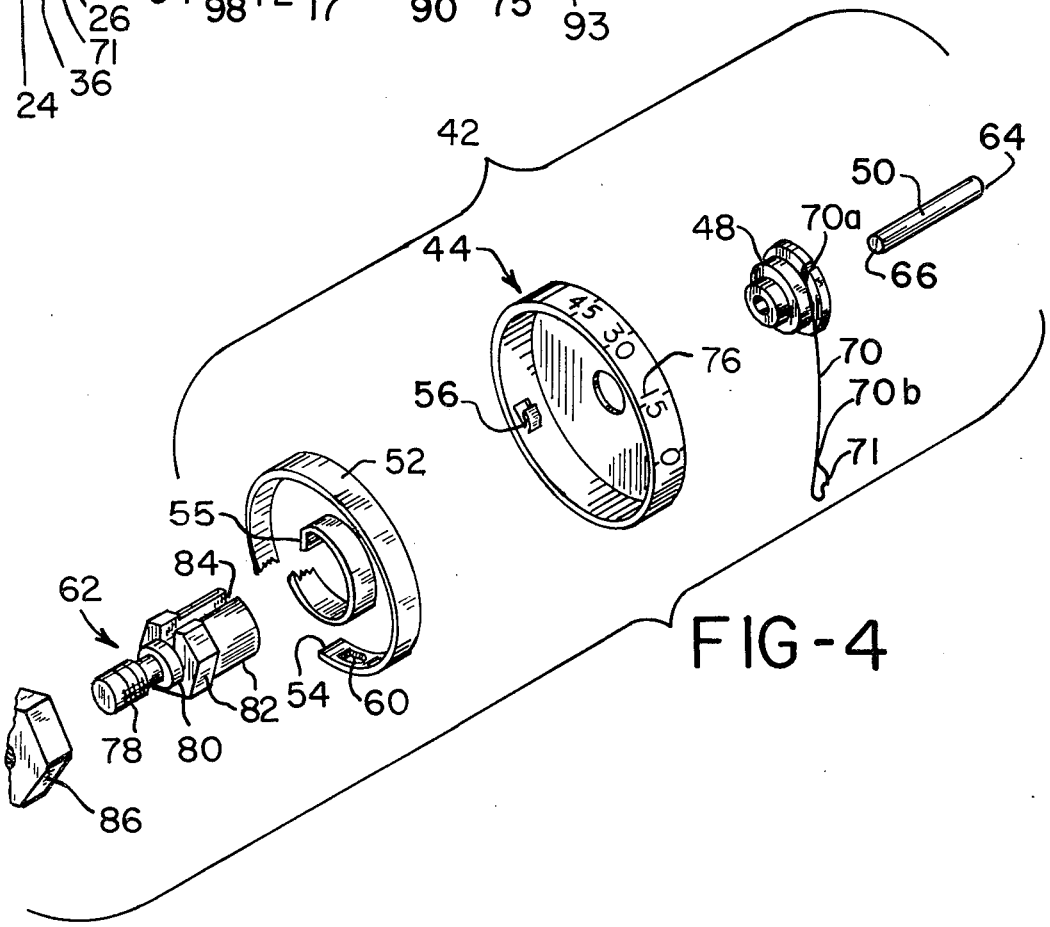
FIG. 4 is an exploded perspective view of the drum assembly.
Figure 7:
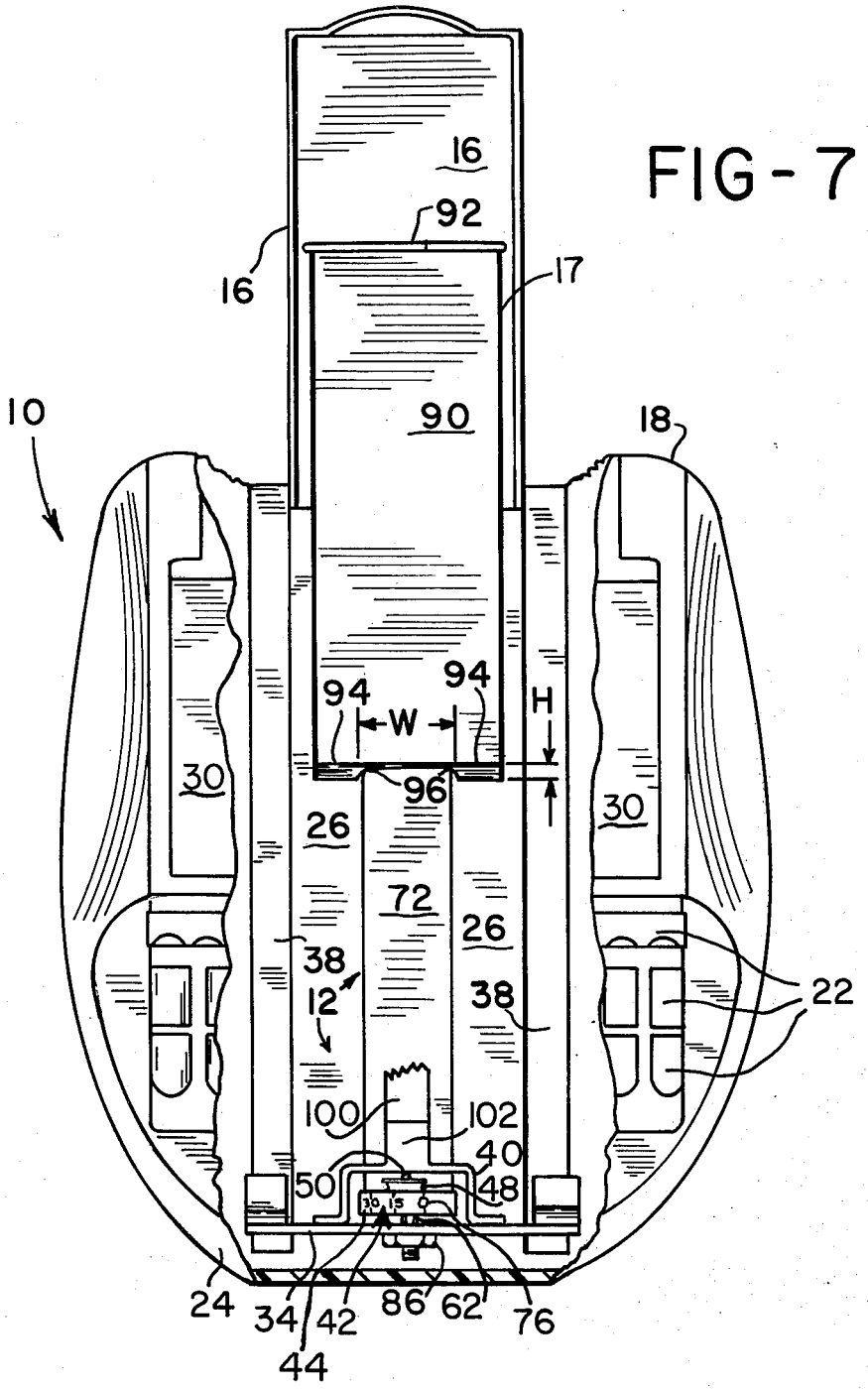
FIG. 7 is a top plan view of the shorthand machine with portions broken away to show the paper gauge.

A drum assembly 42 serves as a biasing means and is mounted between and supported by the outer and inner support brackets 34 and 40 (see FIG. 7). In the preferred embodiment the drum assembly 42 includes a housing 44, as best seen in FIG. 4. A pulley 48 is fixedly secured to the housing 44 and the housing 44 and pulley 48 are fixed to an axle 50.

A torsion spring 52 is mounted inside the housing 44. The axle 50 extends through the center of the torsion spring 52. The outer end 54 of the torsion spring is secured to the housing 44 by tab 56 protruding inwardly from the housing 44. The tab 56 engages a slot 60 in the outer end 54 of the torsion spring 52. The inner end 55 of the torsion spring is secured in a longitudinal slot 84 in an assembly bearing 62, the details of which will be more fully described.

The outer end 64 of the axle 50 extends outwardly from the pulley 48 and is journalled for rotation in the opening 41 in the inner support bracket 40. The inner end 66 of the axle extends outwardly from the torsion spring 52 and is journalled for rotation within the assembly bearing 62. The assembly bearing 62 is adjustably but fixedly secured in the opening 35 of the outer support bracket 34. The housing 44, pulley 48 and axle 50 all rotate together, but the rotation is countered by the torsion spring 52 which is secured both to the housing 44 and assembly bearing 62.

The pulley 48 and housing 44 are rotated by means of a flexible cord or cable 70, one end **70*a* of which is attached to the pulley 48. The free end 70***b* of the cable is attached to scale means such as a scale arm 72 by suitable means as, for example, a hook 71 (see FIG. 3). The scale arm 72 has a free end 74 and a stationary end 75. It is the free end 74 of the scale arm 72 which is secured to the cable 70. The scale arm is secured at its stationary end 75 to the paper track 26 of the shorthand machine.

The scale arm 72 moves between a first or raised position which is assumed when the shorthand machine 10 is out of a paper tape supply and a second position which is assumed when a pre-determined amount (i.e. a full supply) of paper tape 14 is within the machine 10 and rests on the scale arm 72. In the second or depressed position the scale arm rests on the paper track 26. Thus the paper track 26 serves as a limit to the displacement of the scale arm 72 by the paper tape. If more than the pre-determined amount of paper tape is loaded into the machine, the scale arm will not be displaced further. The drum assembly 42 acts as a biasing means to urge against displacement of free end 74 by the paper tape.

Indicating means is carried on the outside circumference of the drum assembly housing 44 in the form of indicia 76. The indicia 76 on the housing is visible to the shorthand machine operator (see FIG. 1) and provides constant readout as to the amount of paper tape remaining to be used. The indicating means, other than the indicia 76, could be of many different configurations, such as an indicating needle attached to the axle which would point to different numbers on a stationary scale. However, by placing indicia 76 directly on the housing 44 of the drum assembly 42, the degree of accuracy may be improved and the cost of the paper gauge is less.

Means is preferably provided for adjusting the drum assembly for continued accuracy of the readout. In the preferred embodiment, this adjustment is provided by assembly bearing 62. As best seen in FIGS. 4, 5A and 5B, the assembly bearing 62 includes a threaded end portion 78, an annular shoulder portion 80 and a body portion 82. The body portion 82 has a blind hole 83 coaxial with the end portion 78, and is provided with a longitudinal slot 84 or other spring fastening means to secure the inner end 55 of the torsion spring 52. The end portion 78 of the assembly bearing is placed through opening 35 of the outer support bracket 34 and is tightened in position by a nut 86 or other fastener. Thus the assembly bearing 62 is maintained in a fixed, but adjustable position. The inner end 66 of the axle 50 is journalled in the blind hole 83, enabling free rotation of the axle 50 therein. The annular shoulder 80 of the assembly bearing 62 fits closely into the opening 35 so as to help maintain the horizontal position of the assembly bearing 62 and the axle 50. The axially rotative position of the assembly bearing is adjustable so as to adjust the tension on the torsion spring 52 and thus the tare reading of the indicia 76 on housing 44. This adjustment may be necessary after extended use of the paper gauge 12.

The invention as above defined will operate properly upon careful attention to loading and maintaining the paper tape 14 squarely on the scale arm 72. However, operation of the paper gauge is greatly enhanced and its accuracy assured by a specially constructed loading means, which in the construction embodying the preferred example of the invention includes a tray plate 17 which enables proper use of the paper gauge 12 in the shorthand machine 10 during everyday use without requiring any special attention to be given to the location and placement of the paper tape 14.

In order to assure proper loading of the paper tape supply into the shorthand machine and onto the scale arm 72, the special hinged tray plate 17 is provided. The tray plate 17 has a base portion 90 and an "L"-shaped end portion 91, hingedly attached to the base portion 90 at the outer or platen end thereof. As best shown in FIG. 8, the "L"-shaped end portion 91 includes a vertical piece 92 and a horizontal piece 93. The hinge 95 may be of suitably strong and flexible material, such as heavy fabric or vinyl. Of course, more traditional means like a door type hinge could be employed but such construction would increase cost. The hinge 95 is secured to both base portion 90 and vertical piece 92 of "L"-shaped end portion 91, thus permitting the base portion 90 to pivot while the end portion 91 remains stationary. The pivoting of the base portion is shown by phantom lines in FIG. 8. The horizontal piece 93 is of a length sufficient to impart the necessary stability to end piece 91, without horizontal piece 93 itself effectively engaging the scale arm 72.

Figure 3:
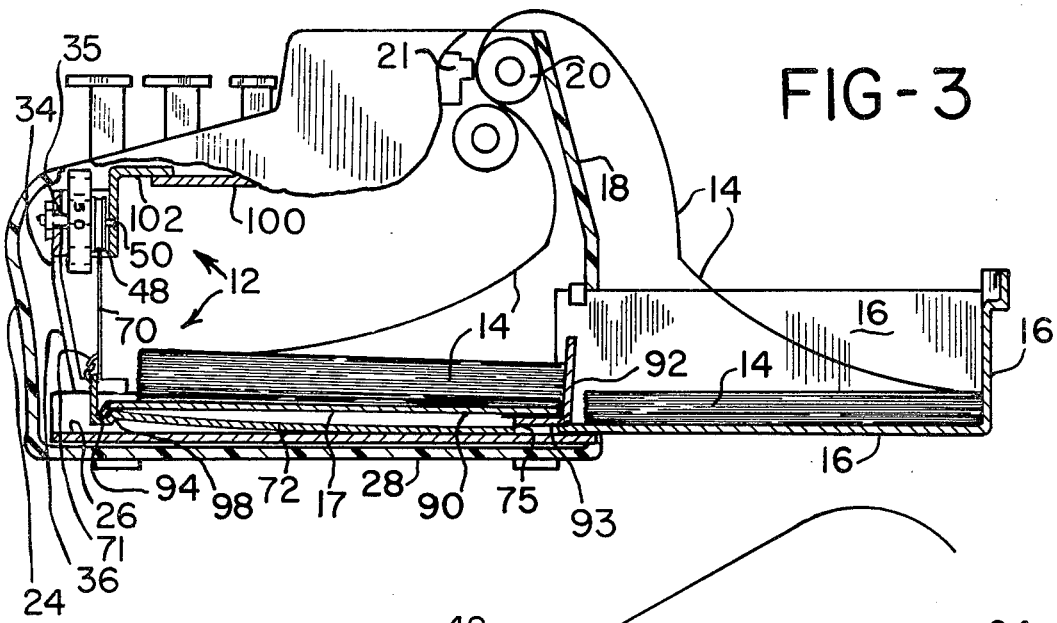
FIG. 3 is a side elevation partially in cross section as in FIG. 2, showing the paper tape after it has been loaded into the shorthand machine and as it is being imprinted by the machine.

As seen in FIGS. 2, 3 and 7 there is at the inner or keyboard end of the base portion 90 a flange 94 extending downwardly toward the scale arm 72. A central channel shaped groove 96 is cut in the flange such that it will accomodate the scale arm 72. The height of the groove is less than the height H of the flange 94. The width W of groove 96 is just large enough to accommodate the scale arm. The free end 74 of the scale arm 72 has a transverse groove 98 the depth of which is less than the height H of the flange 94.

The paper tape 14 is loaded into the shorthand machine by first loading it on the rearwardly positioned tray plate 17 and then sliding tray plate 17 forwardly toward the keyboard end 24 of the machine 10 and onto the paper track 26 (FIG. 3). The scale arm 72, mounted centrally along the longitudinal axis of the paper track 26, engages the groove 96 on the depending flange of the base portion 90 of the tray plate and thus guides the loaded tray plate axially along and over the scale arm 72. The combination of the flange 94 and groove 96 limits lateral motion of the tray plate 17 and paper tape 14, and keeps the paper tape centered on the scale arm 72, (see FIG. 7).

The tray plate 17 is moved forwardly toward the keyboard end 24 of the machine until that portion of the tray plate flange 94 immediately above the channel shaped groove 96 engages and drops into the transverse groove 98 in the scale arm. The operator will then know that the paper tape has correctly engaged the paper gauge. Any tendency of the paper tape 14 to slide toward the platen end of the machine is prevented by end portion 92 of the tray plate 17. The tray plate will not slide back toward the platen of the machine as the flange 94 and transverse groove 98 form a catch means, thus keeping the paper tape 14 properly placed on the scale arm 72 between the keyboard end 24 and platen end 18 of the shorthand machine 10. Such placement is vital to the maximum accuracy of the paper gauge 12 to provide readout on the indicia 76.

The tray plate 17 further preserves the accuracy of the paper gauge by hinging vertical piece 92 and base portion 90. As the scale arm rises with use of the paper tape supply, the base portion 90 rises therewith. Because of hinge 95 however, "L"-shaped end portion 91 does not move. This is important because most shorthand machines are designed such that little space exists between the paper tape supply on the paper track 26 and the paper tape output resting in the paper tray 16. Were the tray plate 17 not hinged, the paper output could engage and come to rest against the vertical piece as it angled theretoward with the rising scale arm and base portion 90. This would tend to displace the scale arm from its "true reading" position.

The horizontal piece 93 of the end portion 91 stabilizes end portion 91 so that vertical piece 92 does indeed remain vertical, even against any urging from the paper tape output. The horizontal piece 93 may even be of a length such that it overlaps somewhat the stationary end 75 of scale arm 72 when tray plate 17 is fully loaded into the machine 10.

Because such positioning affects only the stationary end 75 of scale arm 72, the effect on scale arm displacement is negligible and in any event is substantially constant between the first and second positions of the scale arm 72, so that it may be taken into account in calibration of the drum assembly 42 and indicia 76.

The use of the tray plate 17, because of horizontal piece 93 and especially base portion 90, affects the weight on flexible cable 70 and thus the tare reading of the indicia 76. This tare weight may be compensated for by adjusting the assembly bearing 62, as explained above.

The tray plate 17 will rest on and depress the scale arm 72, thus pulling downwardly on the flexible cable 70 and rotating the pulley 48, axle 50 and housing 44. The torsion spring 52 resiliently resists this downward movement of the cable 70 and rotation of the pulley, axle and housing. As the machine is operated, the supply of paper tape is depleted and the torsion spring 52 gradually overcomes the weight of the remaining paper tape. As this occurs, the free end 74 of the scale arm rises, and the drum assembly housing 44 with the indicia 76 thereon rotates gradually. The indicia 76 may be conveniently numbered to correspond with the number of folds of the paper tape remaining.

The simplicity of the paper gauge, including the direct mechanical relationship between the weight of the paper tape 14 and the readout of the indicia 76 ensures ease of operation, easy repair, and accuracy. The downward displacement of the free end 74 of the scale arm 72 is substantially proportional to the weight of the paper tape 14. Movement of the pulley 48, axle 50 and housing 44 are substantially proportional to the displacement of the free end 74 of the scale arm; therefore, the rotation of the indicia 76 is substantially proportional to the weight of the paper tape and displacement of the free end 74.

The substantially proportional relationship between the weight of the paper tape and the displacement of the free end of the scale arm 72 is maintained between the first and second positions of the scale arm, the second position being the limit of displacement of the free end 74, where the weight of the paper tape 14 is sufficient to depress the free end 74 all the way to the paper track 26. Thus the paper gauge 12 operates when the supply of paper tape 14 has been depleted sufficiently to allow the drum assembly 42 or other biasing means to lift the free end 74 off the paper track 26.

The strength of the torsion spring 52 is chosen so as to maintain the substantially proportional relationship between the weight of the paper tape and the displacement of the scale arm throughout its operating range. Also, in the preferred embodiment the scale arm 72 is flexible so that it bows out underneath the paper tape 14, especially when used in conjunction with tray plate 17 (FIG. 3). Such construction further aids in maintaining the proportional relation between the weight of the paper tape 14 and the displacement of the free end 74 of the scale arm. The indicia 76 is gauged to the weight of the paper tape such that measuring the weight gives an accurate readout of the number of folds remaining.

Also of note, the typical shorthand machine includes a paper finger 100 extending underneath the keyboard 22 which simply serves to prevent the upward movement of the paper tape 14 into the keyboard area as it is wound over the platen and out the machine. The keyboard is thus kept clear for proper operation. With the paper gauge 12 at the keyboard end of the machine, it is convenient to provide a projection 102 extending from the inner support bracket 40 which engages the keyboard end of the paper finger 100 by limiting its upward movement.

While certain features and embodiments of the invention have been described in detail herein, it should be understood that alternatives and modifications may be employed without departing from the scope and spirit of the invention as defined by the appended claims.

What is claimed is:

1. A shorthand machine paper gauge for indicating the amount of paper tape remaining in the machine during operation of the shorthand machine, said paper gauge comprising:

(a) scale means adapted to support and weigh a supply of paper tape placed within the shorthand machine, said scale means being mounted for movement related to the weight of the paper within the machine between a first position which will be assumed when no paper tape is within the shorthand machine, a second position which will be assumed when a pre-determined amount of paper tape is within the shorthand machine, and intermediate positions said scale means being resiliently urged toward said first position; and (b) indicating means operatively connected to said scale means to indicate the position of the scale means and thus the amount of paper within the machine.

2. The paper gauge as in claim 1, said scale means including a scale arm.

3. A shorthand machine paper gauge for indicating the amount of paper tape remaining in the machine during operation of the shorthand machine, said paper gauge comprising:

(a) a scale arm adapted to support and weigh a supply of paper tape placed within the shorthand machine, said scale arm being mounted for movement related to the weight of the paper with the machine between a first position which will be assumed when no paper tape is within the shorthand machine, a second position which will be assumed when a pre-determined amount of paper tape is within the shorthand machine, and intermediate positions said scale arm being resiliently urged toward said first position;

(b) indicating means operatively connected to said scale arm to indicate the position of the scale arm and thus the amount of paper within the machine; and (c) loading means adapted to accommodate the paper tape and enabling the paper tape to be consistently inserted the same distance into the shorthand machine and onto said scale arm, and preventing a paper tape output from urging against said scale arm, said loading means thereby ensuring accurate readings by said indicating means.

4. The paper gauge as in claim 2 or 3, wherein the paper gauge further includes a biasing means for resiliently urging said scale arm toward said first position.

5. The paper gauge as in claim 4, wherein said biasing means is engaged by said scale arm and ensures that movement of said scale arm is substantially proportional to the amount of paper tape resting on said scale arm up to the limit of movement of said scale arm at said second position.

6. The paper gauge as in claim 2 or 3 wherein said scale arm includes a free end and a stationary end operatively connected to the shorthand machine, such that the supply of paper tape placed within the shorthand machine rests at least on said free end.

7. The paper gauge as in claim 6, further including a biasing means for resiliently urging said scale arm toward said first position, said biasing means engaged by said free end, said biasing means and scale arm together ensuring that movement of said free end is substantially proportional to the amount of paper tape resting on said scale arm up to the limit of movement of said scale arm at said second position.

8. The paper gauge as in claim 6, wherein said indicating means moves in response to movement of said scale arm between the first position and the second position such that movement of said indicating means is substantially proportional to the movement of said free end of the scale arm.

9. The paper gauge as in claim 7, further including a support structure mounted in the interior of the shorthand machine and an assembly bearing adjustably but fixedly secured to said support structure, and wherein said biasing means comprises a drum assembly, said drum assembly including:

(a) a drum assembly housing;

(b) an axle fixedly secured to the housing and having an outer end extending out of the drum housing such that said outer end is journalled for rotation in said support structure, and an inner end extending into and through the drum housing such that said inner end is journalled for rotation within said assembly bearing;

(c) a torsion spring inside the drum housing having outer and inner ends such that the outer end of the spring is affixed to the drum housing and the inner end is secured to said assembly bearing;

(d) a pulley fixedly secured to the drum housing; and (e) a cable having one end engaging said pulley and a free end secured to said free end of said scale arm.

10. The paper gauge as in claim 3, wherein said loading means comprises a tray plate, said tray plate including:

(a) a base portion;

(b) an "L"-shaped end portion hingedly attached to the platen end of the base portion and including a vertical piece and a horizontal piece which extends part way underneath said base portion;

(c) a hinge between said base portion and said end portion such that said base portion may pivot with respect to said end portion upon displacement of said scale arm without disturbing said end portion, thereby preventing the paper tape output from urging against said tray plate and said scale arm;

(d) a flange at the keyboard end of the base portion and extending toward the scale arm; and (e) a channel shaped groove in the flange to engage said scale arm, said channel shaped groove and flange together minimizing lateral movement of said tray plate and paper tape on said scale arm;

the scale arm having a transverse groove disposed in the free end thereof whereby the flange and the channel shaped groove of said tray plate engage the transverse groove, the transverse groove and flange thus forming a catch means for said tray plate with the paper tape thereon to allow for consistently inserting said paper tray and paper tape the same distance into the shorthand machine and onto said scale arm.

11. A shorthand machine paper gauge for indicating the amount of paper tape remaining in the machine during operation of the shorthand machine, said paper gauge comprising:

(a) scale means, including a scale arm having a free end and a stationary end operatively connected to the shorthand machine, said scale arm free end being mounted for movement through various intermediate positions related to the weight of the paper within the machine between a first position which will be assumed when no paper tape is within the shorthand machine and a second position which will be assumed when a pre-determined amount of paper tape is within the shorthand machine;

(b) indicating means operatively connected to said scale arm for indicating the position of said free end of the scale arm between said first position and second position of said scale arm;

(c) biasing means operatively engaging one of said means for resiliently urging said scale arm toward said first position, said biasing means ensuring that movement of said free end is substantially proportional to the amount of paper tape resting on said scale arm up to the limit of movement of said scale arm at said second position; and (d) loading means associated with the free end of said scale arm for accommodating the paper tape and for ensuring that the paper tape will be consistently loaded the same distance into the shorthand machine and onto the scale arm for deflection of said scale arm free end, said loading means resting at least on said free end of the scale arm, whereby the amount of deflection of said scale arm free will be in accordance with the amount of paper tape remaining on said loading means and will be indicated by said indicating means.

12. A shorthand machine paper gauge for indicating the amount of paper tape remaining in the machine during operation of the shorthand machine, said paper gauge comprising:

(a) a scale arm, including a free end having a transverse groove disposed therein and a stationary end operatively connected to the shorthand machine, said scale arm adapted to support and weigh a supply of paper tape placed within the shorthand machine, the paper tape resting at least on said free end of said scale arm, said scale arm being mounted for movement related to the weight of the paper within the machine between a first position which will be assumed when no paper tape is within the shorthand machine, a second position which will be assumed when a pre-determined amount of paper tape is within the shorthand machine and intermediate positions;

(b) a support structure mounted in the shorthand machine and including inner and outer support brackets;

(c) an assembly bearing fixedly but adjustably secured to said outer support bracket and including along its longitudinal axis;

i. a threaded end portion extending through said outer support bracket for securing said assembly bearing thereto, ii. an annular shoulder adjacent the threaded end portion and engaging said outer support bracket, iii. a body portion defining a blind hole, and iv. spring fastening means in the body portion to secure the inner end of said spring;

(d) a fastener engaging the threaded end portion of the assembly bearing to secure said assembly bearing to said outer support bracket and to enable manual rotation of the assembly bearing to adjust the tare reading of said paper gauge;

(e) a drum assembly for resiliently urging said scale arm toward said first position, said drum assembly rotatably disposed between said blind hole in said assembly bearing and said inner support bracket and including a torsion spring secured by said spring fastening means, said drum assembly operatively connected to said free end of said scale arm;

(f) indicia carried on said drum assembly, operatively connected to said scale arm and providing constant readout as to the amount of paper tape remaining in the shorthand machine; and (g) a hinged tray plate onto which the paper tape is loaded and which engages said scale arm and transverse groove to minimize lateral movement of the paper tape and to allow for consistently inserting said paper tape the same distance into the shorthand machine and onto said scale arm, said tray plate also preventing a paper tape output from displacing said scale arm, said tray plate thereby ensuring accurate readout by said indicia.

* * * * *

UNITED STATES PATENT AND TRADEMARK OFFICE

CERTIFICATE OF CORRECTION

PATENT NO. : 4,323,316

DATED : April 6, 1982

INVENTOR(S) : Paul J. Fowler et al.

It is certified that error appears in the above-identified patent and that said Letters Patent is hereby corrected as shown below:

Column 8, line 52, "with" should read -- within --.

Column 10, line 47, after "free" should read -- end --.

Signed and Sealed this

*Second* Day of *November 1982*

[SEAL]

*Attest:*

GERALD J. MOSSINGHOFF

*Attesting Officer* *Commissioner of Patents and Trademarks*